United States Patent [19]

Stricker

[11] 3,985,094

[45] Oct. 12, 1976

[54] SERIES WATERJET PROPULSION PUMPS FOR MARINE VEHICLES

[75] Inventor: John G. Stricker, Annapolis, Md.

[73] Assignee: The United States of America as represented by the Secretary of the Navy, Washington, D.C.

[22] Filed: Feb. 20, 1976

[21] Appl. No.: 659,820

[52] U.S. Cl. ..... 115/14; 60/222; 60/229; 115/11; 115/16; 415/145; 417/62; 417/247

[51] Int. Cl.[2] ..... B63H 11/08

[58] Field of Search ..... 115/11, 12 R, 12 A, 115/14, 16; 60/221, 222, 229, 263; 415/145, 149 A, 153 A; 417/62, 246, 247

[56] References Cited

UNITED STATES PATENTS

| | | | |
|---|---|---|---|
| 2,730,065 | 1/1956 | Piper | 115/14 |
| 3,285,214 | 11/1966 | Patton | 60/221 |
| 3,531,214 | 9/1970 | Abramson | 60/221 |
| 3,602,611 | 8/1971 | Oplander | 415/145 |
| 3,763,818 | 10/1973 | Davis | 115/11 |

*Primary Examiner*—Trygve M. Blix
*Assistant Examiner*—Charles E. Frankfort
*Attorney, Agent, or Firm*—R. S. Sciascia; Q. E. Hodges; D. McGiehan

[57] ABSTRACT

A waterjet propulsion system having at least two pumps in series so that inflow from a hull or other intake is directed through a first waterjet propulsion pump; and then via a two-position diverter valve, either out to a thrust nozzle, or to and through a second waterjet propulsion pump having a thrust nozzle. Subsequent series-pump units and diverter valves may follow to provide as many propulsion stages as required for power requirements. Each pump unit is driven by its own power unit which may be shut down when flow is diverted to the preceding unit's thrust nozzle. Good efficiencies are thereby attained over a wide range of power and speed requirements.

5 Claims, 1 Drawing Figure

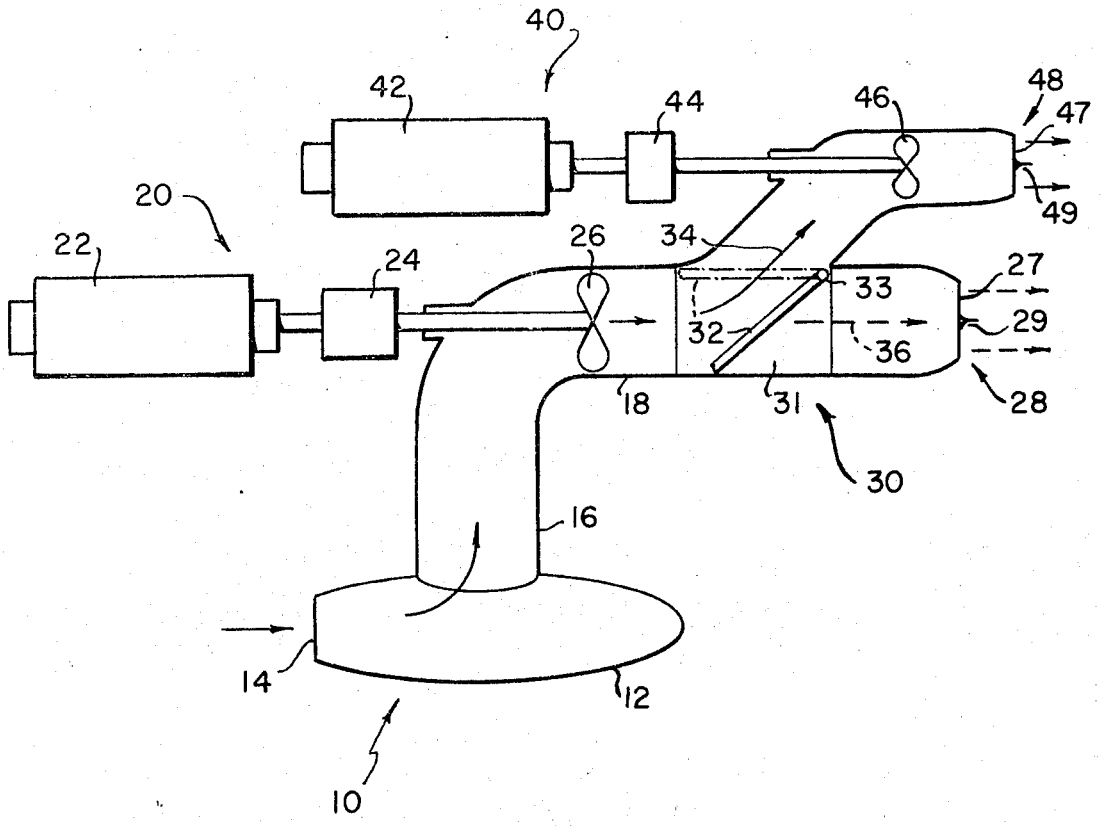
40
42
44
46
48
47
49
20
22
24
26
34
27
33
29
32
36
28
18
31
30
16
14
12
10

SERIES WATERJET PROPULSION PUMPS FOR MARINE VEHICLES

The invention described herein may be manufactured and used by or for the Government of the United States of America for governmental purposes without the payment of any royalties thereon or therefore.

BACKGROUND OF THE INVENTION

A well-known problem in ship propulsion and particularly waterjet propulsion systems, is maintaining efficiencies of a water vehicle and the propulsion system used under all speed and power requirements. One scheme used to maintain efficiency is a plurality of waterjet propulsion units in parallel. Such a parallel arrangement is desirable where a vehicle's power requirements exceed the power available from one unit. In parallel arrangements, each unit normally has its own separate intake, pump, engine, and waterjet. Another variation is to use only one inlet with downstream ducting connected to provide fluid to parallel and separately powered pumps with their separate nozzles. Partial power operation is usually accomplished by changing intake size or by reducing rotational speed and power of the pumps below full-load, design valves, obviously degrading pump and flow efficiencies. Also, another scheme used to reduce power is to shut down one or more propulsion units, and operate the remaining one or more units at full design load, values with efficiency, provided asymetric thrust does not result. But again, efficiency of the vehicle is degraded, because of the drag of the unused intake area remaining open, and the mismatch of the total in-use nozzle area to vehicle hull requirements. When operating all the propulsion units at reduced power, as before, unit-power efficiency is usually drastically reduced, particularly in gas turbine-powered units such as those often used to power many high performance marine vehicles.

An alternative method of providing variable power is to couple two or more power units to each pump-nozzle-intake system, by power-combining transmission systems. Reduced power operation is obtained by power unit shaft speed control, or by decoupling one or more power units. The latter method requires shaft clutches and controls. And, as with individual propulsion units discussed above, power unit efficiency is degraded at reduced power operation, due to shaft speed-to-power mismatch of the pump and power-unit and the losses due to the unused thrust nozzle area. The major disadvantages of the system are the cost, the complexity of the power-combining transmissions, and the restraints placed on their location and arrangement in the vehicle.

SUMMARY OF THE INVENTION

Briefly, the instant invention overcomes the disadvantages of the prior art variable-power waterjet propulsion systems by providing multiple waterjet propulsion units that may operate in series when desired by repositioning a diverter valve therebetween. Each propulsion unit comprises a power unit (gas turbine, steam turbine, internal combustion engine, electric motor, hydraulic or pneumatic motor), interconnecting shafting, a transmission as required, a water pump feeding an exit jet propulsion nozzle, and a pump inflow ducting system. These multiple units are mounted such that the inflow from the water intake on the vehicle is directed through the pump of the first unit. The exit flow from this first unit is directed by a two-position diverter valve, either out the proximate waterjet propulsion thrust nozzle, or through a series-connected second pump which is connected to it associated power unit and thrust nozzle. Additional propulsion units may be series-connected through more diverter valves to provide further variations of thrust output for varying conditions.

OBJECTS OF THE INVENTION

Accordingly, an objective of the present invention is to provide a new, improved, and more efficient waterjet propulsion system.

Another objective of the present invention is to provide a multiple-unit waterjet propulsion system that attains efficiency from part-power to full-power requirements.

A further objective of the instant invention is to eliminate mechanical complexity and location contraints of machinery for multiple-unit waterjet propulsion systems.

Still another objective of the present invention is to reduce production and installation costs of multiple-unit water jet propulsion systems for waterborne vehicles.

A still further objective of the instant invention is efficient alternative means of providing high thrust for burst speed augmentaion, or normal thrust for normal speed operation of marine vehicles.

A still further objective of the invention is to provide a substantial increase in thrust at low craft speed to increase acceleration of the vehicle and/or to match multi-modal hull high drag characteristics.

BRIEF DESCRIPTION OF THE DRAWING

A more complete understanding of the invention and many of the attendant advantages thereto will be apparent from the following detailed description when considered in conjunction with the accompanying drawings, wherein:

The FIGURE is a side schematic view of the series waterjet propulsion system according to the invention.

DESCRIPTION OF THE PREFFERED EMBODIMENT

Referring now to the drawing, there is shown generally a water intake 10, a first waterjet propulsion unit 20, a diverter valve 30, and a second waterjet propulsion unit 40.

The water intake 10 is shown as possibly a nacelle 12, having a blunt intake 14 for the ram and suction intake of water into ducting (not shown). A hollow strut 16 attaches to and supports the inlet nacelle 12 below the waterline and also connects to a horizontal pump housing 18, to conduct the fluid vertically into the first waterjet propulsion unit 20.

The first propulsion unit 20 comprises a power unit 22, such as a gas turbine, or the like previously mentioned, appropriate interconnecting shafting to a transmission 24, for increasing or decreasing rotational speed as required. Connected to the transmission 24 through appropriate shafting, is a water pump 26, represented by an impeller, operating in a substantially horizontal pump housing 18, which may have stationary vanes (not shown).

The exit water flow from the pump 26 is directed to a diverter valve 30, having a housing 31 in which a flap for example, or other type movable element 32 rotates about a pivot 33 to have two alternative positions (shown in a solid-line and a dashed-line position). The free edge of the flap 32 points into the flow stream from the pump 26. Directly in line with the diverter valve housing 31 and the pump 26 is a waterjet thrust nozzle 28 which may comprise an annulus 27 surrounding a coaxial pintle 29 which constricts and thereby increases the jet velocity.

Mounted above the first propulsion unit 20 is a second propulsion unit 40 comprising a power unit 42, interconnecting shafting to a transmission 44 that drives a second water pump 46 operating in a second pump housing 45. This housing is connected to an alternate exit of the diverter valve 30. The output flow from the second water pump 46 is directed to a second waterjet thrust nozzle 48, which may comprise an annulus 47 surrounding a coaxial pintle 49 which are used to increase output jet velocity.

The operation of the series arrangement of waterjet propulsion units has been described in the structural description, but the alternative operating arrangements may be further described hereinafter. In essence, the first and main propulsion unit may be operated from zero to mid range speeds with only the propulsion unit 20. In this case, the diverter valve flap 32 will be in the dashed-line position, blocking flow (shown by solid-line arrow 34) to the second propulsion unit 40, and following the flow of the dashed-line arrow 36, and out the first thrust nozzle 28, in a conventional manner. The second propulsion unit may be shut down at this time. Alternatively, and novel to this invention, when the flap 32 is in the solid-line position, the first thrust nozzle 28 is cut off, and flow is directed, as shown by the solid-line arrow 34 to the second pump 46 of the second propulsion unit 40, which is then energized to add additional power to the water flow from the first propulsion unit 20, so as to provide augmented thrust power out the second waterjet thrust nozzle 48, even though the first thrust nozzle 28 is cut off. Thus, efficient part-power to full-power operation is attained because no nozzle area is added, and concomitantly, no nozzle area is lost (there may be some gain) when reducing power.

Obviously, numerous modifications and variations of the present invention are possible in light of the above teachings. It is therefore to be understood that within the scope of the appended claims, the invention may be practiced otherwise than as specifically described.

What is claimed is:

1. A multiple-unit waterjet propulsion system for marine vehicles comprising:

a first waterjet propulsion pump having a water intake flow and a exit flow;

a diverter valve, having a first and a second outlet, attached to the exit flow end of said first pump;

a first thrust nozzle for receiving the exit flow from the first outlet of said diverter valve;

a series-connected waterjet propulsion pump connected to the second outlet of said diverter valve for receiving the exit flow from said first waterjet propulsion pump; and a second thrust nozzle connected to receive the flow output from said first pump through said diverter valve when augmented thrust is desired.

2. The multiple-unit waterjet propulsion system of claim 1 further comprising:

a first power unit for driving said first waterjet propulsion pump; and a second power unit for driving said series-connected waterjet propulsion pump.

3. The multiple-unit waterjet propulsion system of claim 2 further comprising:

a first transmission interposed between said first power unit and said first waterjet propulsion pump; and a second transmission interposed between said second power unit and said series-connected waterjet propulsion unit.

4. The multiple-unit waterjet propulsion system of claim 3 wherein said first and said second thrust nozzles further comprise:

a constricting annulus adjacent the tip of said nozzles; and a pintle coaxially positioned inside the constricting annulus;

whereby the waterflow from said propulsion pumps is increased in velocity to provide high thrust.

5. The multiple-unit waterjet propulsion system of claim 4 wherein said diverter valve further comprises:

a flap pivoted at one end thereof so that said flap points into the flow stream of said first propulsion pump to provide two-way diversion; and a pivot pin rotatably connecting said flap to the housing of said diverter valve.

* * * * *